United States Patent [19]

Bulin

[11] Patent Number: 4,608,940

[45] Date of Patent: Sep. 2, 1986

[54] REMOTE WEIGHT RELEASE FOR A BOUYANCY CONTROL DEVICE

[76] Inventor: Dennis G. Bulin, P.O. Box 1144, Zephyrhills, Fla. 34248

[21] Appl. No.: 672,471

[22] Filed: Nov. 19, 1984

[51] Int. Cl.[4] ..... B63C 11/46

[52] U.S. Cl. ..... 114/315; 114/331

[58] Field of Search ..... 114/315, 317, 331, 333; 272/119; 405/186

[56] References Cited

U.S. PATENT DOCUMENTS

| | | | |
|---|---|---|---|
| 3,670,509 | 6/1972 | Walters | 405/186 |
| 3,964,266 | 6/1976 | Bartlett | 114/333 |
| 4,114,389 | 9/1978 | Bohmrich et al. | 405/186 |
| 4,455,718 | 6/1984 | Finnern | 114/315 |

*Primary Examiner*—Trygve M. Blix
*Assistant Examiner*—Jesûs D. Sotelo
*Attorney, Agent, or Firm*—Frijouf, Rust & Pyle

[57] ABSTRACT

A device is disclosed for the release by remote control of a weight from a diving bouyancy control device or vest. The device includes a sheet of flexible material secured to the bouyancy control device with the material and the bouyancy control device defining a pocket therebetween the releasable receiving the weight. The pocket has a first open end or bottom such that the weight may freely exit from the pocket through the first open end of the pocket. A fastening device is disposed adjacent to the first open end of the pocket for controlling the passage of the weight through the first open end of the pocket. A remote control device is connected to the fastening device for remotely controlling the fastening device such that in a first position of the control device, the fastening device closes the first open end of the pocket to inhibit the passage of the weight therethrough. In a second position of the control device the fastening device opens the first open end of the pocket to permit the weight to pass therethrough to increase the bouyancy of the bouyancy control device.

12 Claims, 11 Drawing Figures

REMOTE WEIGHT RELEASE FOR A BOUYANCY CONTROL DEVICE

BACKGROUND OF THE INVENTION

1. Field of the Invention

This invention relates to a remote control weight release device for a diving bouyancy control device or the like. More specifically, this invention relates to an open bottom pocket for a diving bouyancy control device in which the open bottom controls the passage therethrough of a buoyancy control weight.

2. Information Disclosure Statement

In order to control the buoyancy of a diver, a diver will wear a belt to which weights are attached. If a diver encounters any difficulties while under water, it is usual for the diver or the diver's partner or rescuer to discard the weighted belt in order to increase the diver's buoyancy and facilitate a return to the surface. However, in the prior art such weighted belts are usually difficult to discard in an emergency because the diver is required to manually release a buckle mechanism to release the weighted belt from around the waist of the diver. Often the buckle may be obstructed by other equipment or may be confused with other buckles. Furthermore, the individual weights which are attached to the belt often slide relative to the belt and become uncomfortably lodged between the body of the diver and the air tank. In addition to the disadvantage described hereinbefore, each individual weight must be molded such that the belt is able to be looped through the individual weights to retain the weights thereon.

In view of these disadvantages as stated hereinbefore, there has existed a need in the diving art of a weighted bouyancy control device or belt in which the weights may be easily discarded by the diver without the need for unfastening a relatively complex buckle device.

In the prior art, British Pat. No. 1,587,124 to Morgan teaches a weighted belt or jacket for divers in which a plurality of pockets contain block-shaped weights which may be released by the diver by manually pulling open a flap associated with the bottom of each pocket ot permit the weight within the pocket to be discarded.

While the aforementioned British Patent provides a marked improvement over the previously used weighted belts, a need has still existed in the art for a remote control for enabling the remote release of a weight from a pocket or pockets by the diver in distress or a rescuer.

The present invention overcomes the aforesaid inadequacies of the prior art by providing a pocket which is open at the bottom or lower end thereof. The pocket receives a weight therein and the open bottom of the pocket controllably permits the passage therethrough the weight.

Furthermore, the present invention provides a pressure gauge which is rigidly connected to the housing of the inflatng and exhausting valve thereby avoiding the necessity of an additional flexible hose for connecting the pressure gauge to the first stage regulator.

Therefore, it is a primary object of this invention to provide an apparatus that overcomes the aforementioned inadequacies of the prior art devices and provides an improvement which significantly contributes to the efficiency with which weights can be discarded by a diver.

Another object of the present invention is the provision of a buoyancy control device for a diver in which the bouyancy control device defines a pocket which is open at the bottom or first open end thereof and a fastening device is disposed adjacent the open bottom of the pocket. A remote control device controllably releases the fastening device such that in a first position of the control device, the weight is inhibited from passing through the open bottom of the pocket and in a second position of the control device, the weight is allowed to pass through the open bottom of the pocket to increase the buoyancy of the diver.

Another object of the present invention is the provision of a sheet of flexible material secured to the bouyancy control device such that the material and the bouyancy control device define therebetween a pocket for the releasable reception of the weight. The pocket has a first open end at the bottom thereof such that the weight may freely exit from the pocket through the open bottom of the pocket.

Another object of the present invention is the provision of a remote control weight release device in which the flexible material includes a seam for securing the flexible material adjacent to the bouyancy control device such that the sheet of flexible material, the seam, and the bouyancy control device define a top or second open end which is disposed opposite to the bottom or first open end. The second open end permits the loading of the weight therein.

Another object of the present invention is the provision of a zipper for closing the second open end of the pocket.

Another object of the present invention is the provision of a remote control weight release device for a diving bouyancy control device in which the fastening device includes a plurality of first eyelets which extend through the sheet of flexible material adjacent to the first open end of the pocket. A flexible loop is secured to the inner surface of the sheet of flexible material such that when the pocket is folded concertinawise, the flexible loop extends from the inner surface of the sheet of flexible material through aligned eyelets of the first plurality of eyelets. A second eyelet extends through the bouyancy control device and is aligned with the first plurality of eyelets such that the flexible loop is threaded through the second eyelet. A removable device extends through the flexible loop to lock the flexible loop in a first position of the control means in which the flexible loop extends through the first plurality of eyelets and the second eyelet to close the first open end of the pocket to inhibit the passage of the weight therethrough.

Another object of the present invention is the provision of a remote weight release device having a handle disposed adjacent to the bouyancy control device and remote from the first open end of the pocket. A guide channel defined by the bouyancy control device extends between the handle and the first open end of the pocket. A cord is connected to the handle and extends through the guide channel such that the distal end of the flexible cord passes through the flexible loop of the fastening device to maintain the first open end of the pocket in a closed disposition thereof when the flexible cord is in the first position of the control means. The distal end of the flexible cord is disengaged from the fastening device on movement of the handle away from the guide channel or handle securing device to release the fastening device and open the first open end of the pocket to permit the passage of the weight therethrough.

Another object of the present invention is the provision of a remote control weight release device in which the second eyelet extends through a lining material secured to the bouyancy control device such that the guide channel guides the distal end of the flexible cord between the lining and the bouyancy control device for engagement with the flexible loop.

Another object of the present invention is the provision of a remote control weight release device in which the bouyancy control device defines a plurality of slots for the reception therein of loop-shape straps. A buckle is secured to the distal end of each of the loop-shaped straps to clamp an air tank to the bouyancy control device.

Another object of the present invention is the provision of an inverted T-shaped vest which is secured to an inflatable bouyancy device. The bouyancy control device defines a plurality of slots. A plurality of body engaging straps extend from the inverted T-shaped vest for securing the bouyancy control device around the torso of diver.

Another object of the present invention is the provision of a combination inflation valve and submersible pressure gauge.

Another object of the present invention is the provision of a valve for inflating and exhausting the bouyancy chamber of a bouyancy control device in which a pressure gauge is rigidly connected to the inflation and exhaust valve housing.

The foregoing has outlined some of the more pertinent objects of the present invention. These objects should be construed to be merely illustrative of some of the more prominent features and applications of the invention. Many other beneficial results can be obtained by applying the disclosed invention in a different manner or modifying the invention within the scope of the disclosure. Particularly with regard to the use of the invention disclosed herein, this should not be construed as being limited to a remote control weight release device for a bouyancy control device of a diver but should include a remote control device for releasing weights from a diving belt, diving backpack, diving tank, diving suit, or the like.

SUMMARY OF THE INVENTION

The remote control weight release device of the present invention is defined by the appended claims with a specific embodiment shown in the attached drawings. For the purpose of summarizing the invention, the invention relates to a remote control weight release device for a diving bouyancy control device or the like. The remote control weight release device includes a sheet of flexible material secured to the bouyancy control device, the material and the bouyancy control device defining therebetween a pocket for releasably receiving the weight therein. The pocket has a first open end such that the weight may freely exit from the pocket through the first open end of the pocket. A fastening device is disposed adjacent to the first open end of the pocket for fastening the first open end of the pocket for controlling the passage of the weight through the first open end of the pocket. A remote control device is connected to the fastening device for remotely controlling the fastening device such that in a first position of the control device the fastening device closes the first open end of the pocket to inhibit the passage of the weight therethrough and such that in a second position of the control device the fastening device releases the first open end of the pocket to permit the weight to pass through the first open end of the pocket to increase the buoyancy of the diving bouyancy control device.

In a more specific embodiment of the invention, the sheet of flexible material includes a seam for securing the sheet of flexible material adjacent to the bouyancy control device such that the sheet of flexible material, the seam and the bouyancy control device define a second closeable end which is disposed opposite to the first open end. The second open end permits the loading of the weight therein. The second open end includes a zipper device for closing the second end of the pocket. The fastening device further includes a plurality of first eyelets extending through the sheet of flexible material adjacent to the first open end of the pocket. A flexible loop is secured to the inner surface of the sheet of flexible material such that when the pocket is folded concertinawise, the flexible loop extends from the inner surface of the sheet of flexible material through aligned eyelets of the plurality of first eyelets. A second eyelet extends through the bouyancy control device and is aligned with the first plurality of eyelets such that the flexible loop is threaded through the second eyelet. A removable device extends through the flexible loop to lock the flexible loop in the first position of the control device in which the flexible loop extends through the first plurality of eyelets and the second eyelet to close the first open end of the pocket thereby inhibiting the passage of the weight therethrough.

The remote control device further includes a handle which is disposed adjacent to the bouyancy control device and remote from the first open end of the pocket. A guide channel defined by the bouyancy control device extends between the handle and the first open end of the pocket. A cord is connected to the handle and extends through the guide channel such that the distal end of the flexible cord passes through the fastening device to close the first open end of the pocket when the flexible cord is in the first position of the control device. The distal end of the flexible cord is disengaged from the fastening device on movement of the handle away from the guide channel to thereby release the fastening device to open the first open end of the pocket thereby permitting the passage of the weight therethrough.

The second eyelet extends through a lining material which is secured to the bouyancy control device such that the guide channel guides the distal end of the cord between the lining and the bouyancy control device for engagement with the flexible loop. The bouyancy control device includes an air chamber portion or first portion which defines a plurality of slots for the reception of loop-shaped straps therethrough. The loop-shaped straps include buckles secured to the distal ends of the loop-shaped straps such that an air tank extending through and between the loop-shaped straps may be locked against the bouyancy control device by the clamping operation of the buckles. The bouyancy control device also includes an inverted T-shaped portion permanently secured to the first portion. The T-shaped portion further includes a plurality of body engaging straps for securing the bouyancy control device around the torso of the diver. The sheet of flexible material is secured to the inverted T-shaped portion of the bouyancy control device.

In another embodiment of the present invention, a valve for inflating and exhausting a bouyancy chamber of a bouyancy control device includes a valve housing which defines a first chamber and means for connecting the first chamber to a source of pressurized air. The valve housing defines a second chamber which is in fluid communication with both the first chamber and a bouyancy chamber of the bouyancy control device. An inflation valve is slidably disposed relative to the first and second chambers for selectively permitting fluid communication between the first and the second chambers such that in a first position of the inflation valve the pressurized air within the first chamber flows past the inflation valve into the second chamber and into the bouyancy chamber. In a second position of the inflation valve air is prevented from flowing from the second chamber back into the first chamber. An exhaust valve extends through a third chamber defined by the housing and the exhaust valve selectively controls flow of air from the second chamber through an orifice connecting the second and third chambers. The exhaust valve permits alternately the exhausting of air from the bouyancy chamber to the third chamber and manual filling of the bouyancy chamber by manually blowing air from the third chamber into the second chamber to inflate a bouyancy chamber. The inflating and exhaust valve housing also includes a pressure gauge which is rigidly connected to and in fluid communication with the first chamber for permitting reading of the air pressure within the first chamber.

The foregoing has outlined rather broadly the more pertinent and important features of the present invention in order that the detailed description of the invention that follows may be better understood so that the present contribution of the art can be more fully appreciated. Additionally, features of the invention will be disclosed or described hereinafter which form the subject of the claims of the invention. It should be appreciated by those skilled in the art that the conception and specific embodiment disclosed may be readily utilized as a basis for modifying or designing other devices for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following description taken in conjunction the accompanying drawings in which.

Similar reference characters refer to similar parts throughout the several views of the drawings.

DETAILED DESCRIPTION

Figure 1:
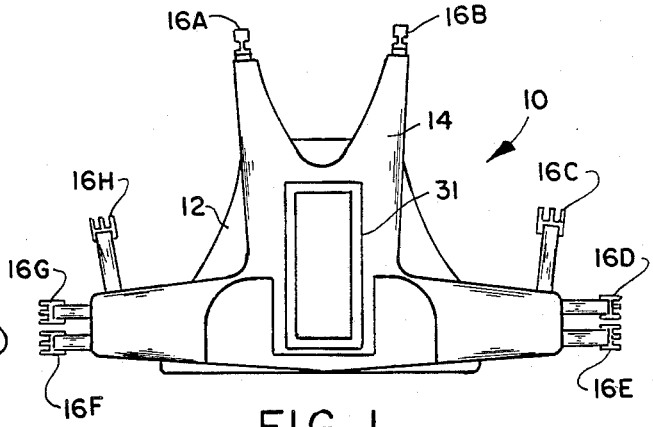
FIG. 1 is a bottom plan view of the diving bouyancy control device of the present invention showing the inner-surface of the bouyancy control device.

FIG. 1 is a bottom plan view of the remote control weight release device for a diving bouyancy control device incorporating the present invention. The diving bouyancy control device generally designated 10 is shown as a flexible fabric material and includes a first portion 12 which is described in more detail hereinafter. The bouyancy control device 10 also includes an inverted T-shaped portion 14 having attached thereto a plurality of body engaging straps **16*a*, 16*b*, 16*c*, 16*d*, 16*e*, 16*f*, 16*g* and 16*h*** for securing the bouyancy control device to a diver (not shown).

Figure 2:
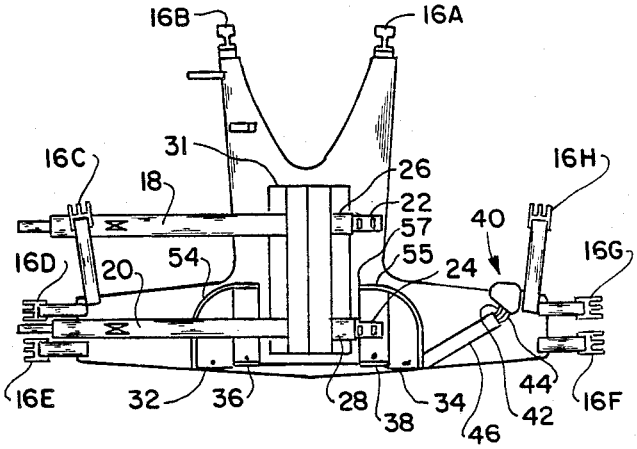
FIG. 2 is a top plan view of the diving bouyancy control device shown in FIG. 1 but further showing a first portion of the bouyancy control device or bouyancy chamber removed from the inverted T-shaped portion and with the loop shaped straps opened out.
Figure 5:
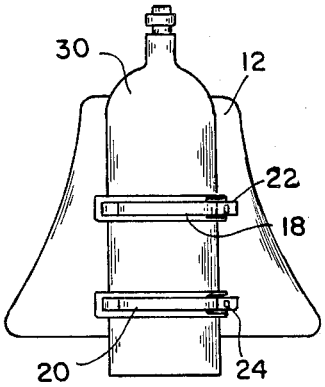
FIG. 5 shows an air bottle extending through and between the loop-shaped straps and locked agaist the bouyancy control device by the clamping operation of the buckles.

FIG. 2 is a top plan view showing the inverted T-shaped portion 14 with the first portion 12 removed therefrom. The inverted T-shaped portion 14 of the bouyancy control device 10 includes two loop-shaped straps 18 and 20 respectively permanently secured to the inverted T-shaped portion 14. The loop-shaped straps 18 and 20 include buckles 22 and 24 respectively which are secured to the distal ends 26 and 28 respectively of the loop-shaped straps 18 and 20 such that an air tank 30 as shown in FIG. 5 extending through and between the loop-shaped straps 18 and 20 may be locked against the bouyancy control device 10 by the clamping operation of the buckles 22 and 24. A rectangular portion 31, as shown in FIGS. 1 and 2 represents stiffening material proximate the location of the air tank contained by double stitching which extends through the fabric of the inverted T-shaped portion 14 for securing the straps 18 and 20 to the portion 14. FIG. 2 shows the disposition of a left hand pocket generally designated 32 and right hand pocket 34 having a first open end or bottom end 36 and 38 respectively which is able to be opened by operation of a remote control device generally designated 40 comprising a handle connected to semi-flexible cords 42 and 44 respectively and a guide channel 46. Details of the remote control device will be described in detail hereinafter.

Figure 3:
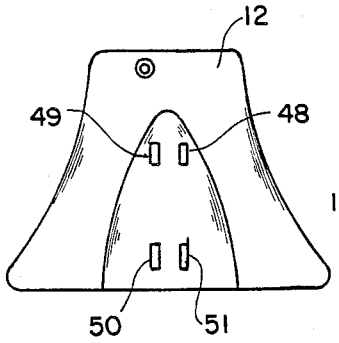
FIG. 3 is a top plan view of the first portion or bouyancy chamber of the diving bouyancy control device showing the plurality of slots for receiving therethrough the loop-shaped straps.

FIG. 3 is a top plan view of the first portion 12 of the bouyancy control device 10 showing a plurality of slots 48, 49, 50 and 51 for the reception therethrough of the loop-shaped straps 18 and 20 and buckles 22 and 24.

Figure 4:
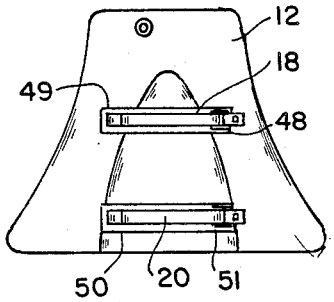
FIG. 4 is a similar view to that shown in FIG. 3 but shows the loop-shaped straps extending through the first portion of the bouyancy control device.

FIG. 4 is a top plan view of the first portion 12 of the bouyancy control device 10 with the inverted T-shaped portion 14 removed but showing the loop-shaped straps 18 and 20 and buckles 22 and 24 extending through the slots 48, 49, 50, and 51.

FIG. 5 is a similar view to that shown in FIG. 4 but shows respectively the air tank 30 extending through and between the loop-shaped straps 18 and 20 with the straps 18 and 20 locked against the bouyancy control device by the clamping operation of the buckles 22 and 24 respectively.

Figure 6:
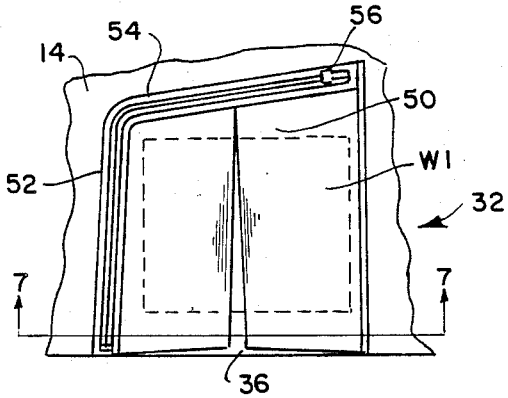
FIG. 6 is an enlarged view of the left hand pocket as shown in FIG. 2 showing the first open end of the pocket in the closed disposition thereof.

FIG. 6 is an enlarged view of the left hand pocket 32 shown in FIG. 2 and shows in phantom outline the disposition therein of the weight W1 when the first open end generally designated 36 of the left hand pocket 32 is disposed in the closed disposition thereof. The left hand pocket 32 includes a sheet of flexible material 50 which is secured to the inverted T-shaped portion 14 of the bouyancy control device 10 by means of a seam 52. A second open end 54 of the pocket defined by 32; the sheet of flexible material 50, and the seam 52 and the inverted T-shaped portion 14 of the bouyancy control device 10 and is selectively closeable by means of a zipper 56.

Figure 7:
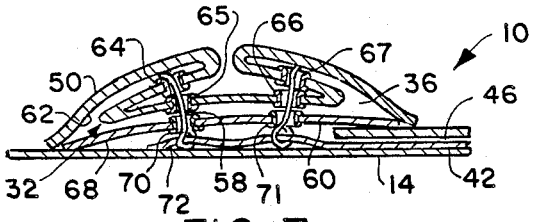
FIG. 7 is a sectional view taken on the line 7—7 of FIG. 6 showing the first end of the pocket in a closed disposition thereof.

FIG. 7 is a sectional view of the first open end 36 of the left hand pocket 36 and shows the sheet of flexible material 50 folded in generally concentinawise fashion or with various accordion folds or in z-shaped transversed cross-sectional configuration as shown in FIG. 7. FIG. 7 shows a pair of flexible loops 58 and 60 secured to the inner surface 62 of the sheet of flexible material 50. A first plurality of eyelets 64, 65, 66, and 67 extend through the sheet of flexible material 50 such that when the sheet of flexible material 50 is folded into the disposition shown in FIG. 7 the flexible loops 58 and 60 extend respectively through eyelets 64, 65 and 66, 67 respectively of the first plurality of eyelets 64–67. A lining material 68 is secured to the inverted T-shaped portion 14 of the bouyancy control device 10 and is disposed between the portion 14 and the sheet of flexible material 50. A second plurality of eyelets 70 and 71 extend through the lining material 68 and are aligned with the corresponding eyelets of the first plurality of eyelets 64–67. When the sheet of flexible material 50 is folded to the disposition shown in FIG. 7 the flexible loop 58 and extends through the second eyelet 70 and are prevented from retracting back through the respective eyelets to 65 and 64 by means of the engagement therethrough of the distal end 72 of the semi-flexible cord 42. Similarly, the flexible loop 60 extends through the second eyelet 71 and is prevented from retracting back through the eyelets 71, 67 and 66 by means of the engagement through the loop 60 of the distal end 72 of the semi flexible cord 42.

Figure 8:
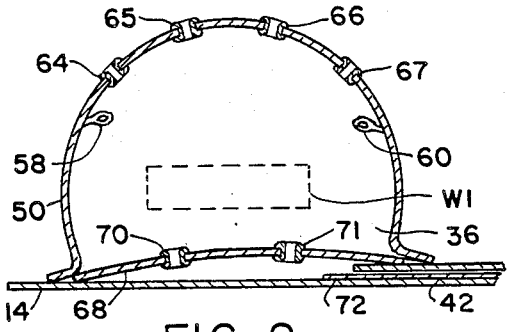
FIG. 8 is a similar view to that shown in FIG. 7 but shows the sheet of flexible material with the first open end of the pocket in the open disposition thereof for permitting the release therethrough of the weight.

FIG. 8 shows the distal end 72 of the flexible cord 42 retracted from between the lining material 68 and the inverted T-shaped portion 14 of the bouyancy control device thereby permitting the flexible loops 58 and 60 to retract from their respective eyelets 70, 65, 64 and 71, 66, 67 thereby permitting the open end 36 of the pocket 32 to open such that the weight W1 may pass therethrough to increase the buoyancy of the diver.

Figure 9:
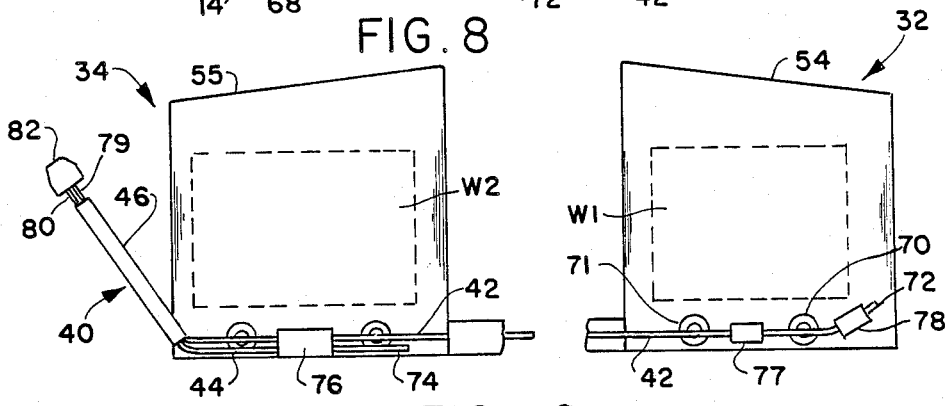
FIG. 9 is a fragmentary view of the pockets shown in FIG. 2 with the handle in the first position thereof for retaining the weights within the respective pockets.

FIG. 9 shows the left and right hand pockets 32 and 34 respectively of the bouyancy control device 10 and shows the respective distal ends 72 and 74 of the flexible cords 42 and 44 disposed in a loop engaging disposition thereof to maintain the respective open ends 36 and 38 of the pockets 32 and 36 in the closed disposition thereof. The semi-flexible cords 42 and 44 are guided by means of guide channels 46, 76, 77 and 78 respectively and the proximal ends 79 and 80 of the respective cords 42 and 44 are anchored adjacent a handle 82 of the remote control weight release device 40.

Figure 10:
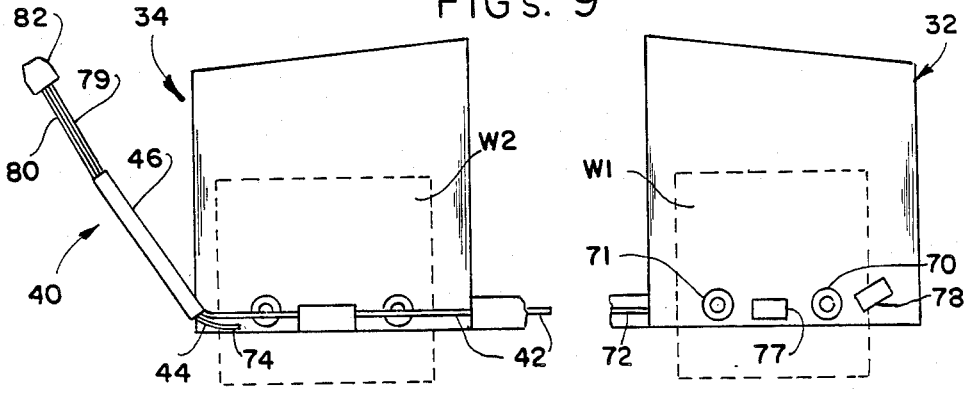
FIG. 10 is a similar view to that shown in FIG. 9 but shows the handle of the remote control device in the second disposition thereof for permitting the passage of the weights through the respective open ends of the pockets.

FIG. 10 is a similar view to that shown in FIG. 9 but shows the handle 82 of the remote control device 40 having been pulled outwardly relative to the guide channel 46 by the diver such that the distal ends 72 and 74 respectively of the semi-flexible cords 42 and 44 are disengaged from locking engagement with the respective flexible loops 58 and 60 of the pocket 32 and the corresponding flexible loops of the other pocket 34. With the remote control device shown in the second disposition thereof as shown in FIG. 10 the respective weights W1 and W2 of the left and right hand pockets 32 and 34 respectively are permitted to exit from the respective pockets thereby increasing the buoyancy of the diver.

In operation of the device of the present invention as shown in FIG. 1–10, the loop-shaped straps 18 and 20 are threaded through the respective slots 48 and 51 of the first portion 12 and the air bottle 30 is clamped against the first portion 12 by means of the respective buckles 22 and 24. The bouyancy control device 10 is secured around the torso of a diver by engagement of the plurality of body engaging straps **16*a–h* and the weights W1 and W2 respectively are loaded into the second open ends 54 and 55 respectively of the left and right hand pockets 32 and 34. Prior to putting on the diving bouyancy control device 10 of the present invention, the flexible loops 58 and 60 are threaded through the respective eyelets as shown in FIG. 7 with the distal ends 72 and 74 of the flexible cords 42 and 44 extending through the flexible loops 58 and 60 respectively to lock the same into the diposition as shown in FIG. 7. With the weights W1 and W2 located in the respective pockets 32 and 34 the zippers 56 and 57** are closed to retain the weights W1 and W2 within the respective pockets.

When the diver or rescuer wishes to release the respective weights W1 and W2 from the bouyancy control device, the diver or rescuer pulls the handle 82 outwardly relative to the guide channel 46 so that the distal ends 72 and 74 of the respective semi-flexible cords 42 and 44 disengage from the respective flexible loops of the pockets 32 and 34 thereby permitting the weight of the weights W1 and W2 to urge the folded sheets of flexible material to the open disposition thereof as shown in FIG. 8 thereby permitting the weights W1 and W2 to pass through the open ends 36 and 38 of the respective pockets 32 and 34 thereby increasing the buoyancy of the diver.

Figure 11:
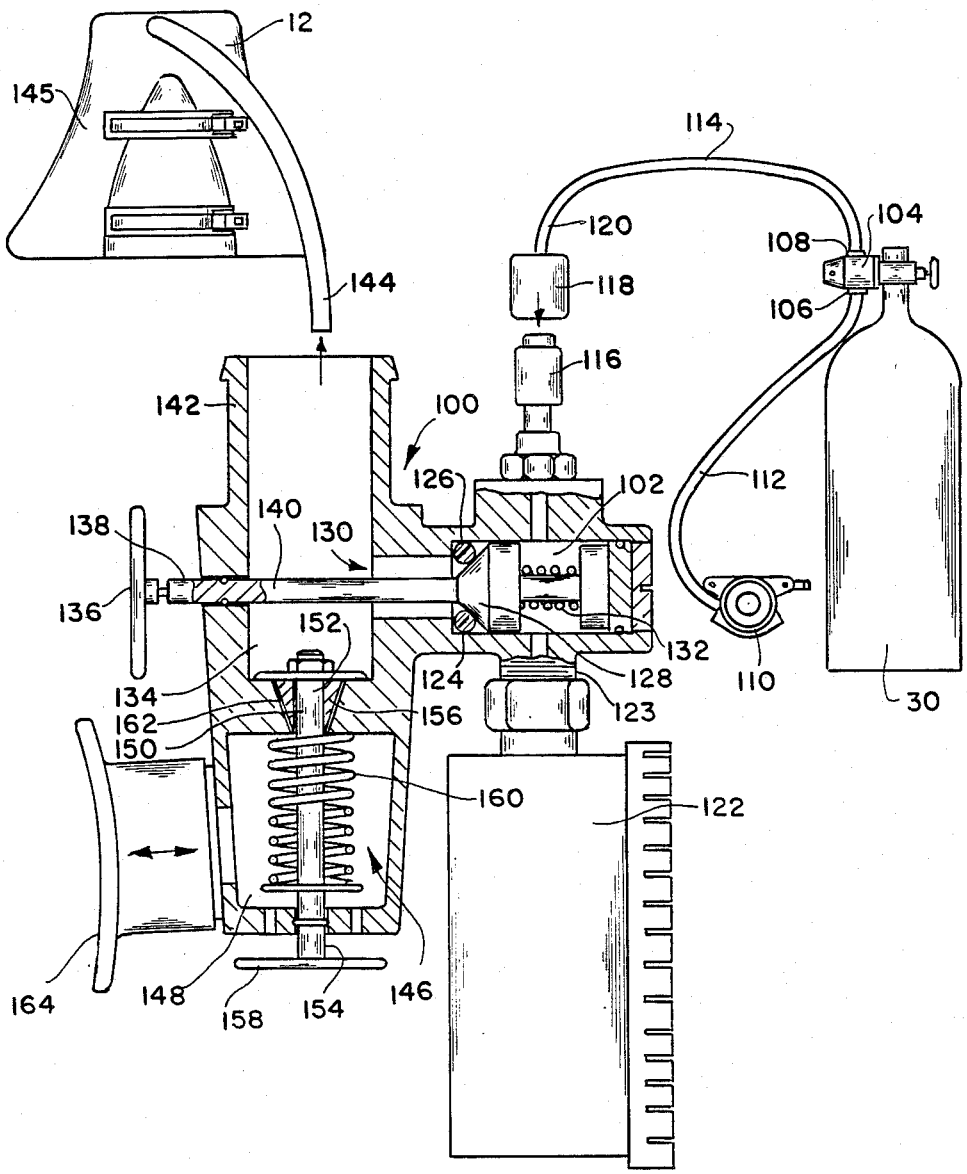
FIG. 11 is a fragmentary view partially in section of a valve for inflating and exhausting a bouyancy chamber of a bouyancy control device according to the present invention.

Another embodiment of the present invention is shown more specifically with reference to FIG. 11 and includes a valve housing generally designated 100 for permitting the passage of air from the tank 30 into a first chamber 102 of the housing 100. As shown in FIG. 11, the tank 30 includes a first stage regulator 104 having a first and second outlet 106 and 108 respectively. A second stage regulator 110 is connected to the first outlet 106 by means of a first hose 112. Air at the tank pressure is supplied to the valve housing 100 by means of a second hose 114.

As in FIG. 11 the second hose 114 is releasably connected to an inlet spigot 116 of the valve housing 100. A releasable coupling 118 of the type well known to those skilled in the art connects the distal end 120 of the hose 114 with the spigot 116 and includes a one-way valve, for example a Schrader valve, such that when the second hose 114 is released for the spigot 116, pressurized air is prevented from escaping from the distal end 120 of the second hose 114.

A pressure gauge 122 includes a threaded portion 123 which threadably cooperates with the valve housing 100 opposite to the spigot 116 such that air at a pressure regulated by the first stage regulator 104 is constantly supplied to the pressure gauge 122. This feature of the present invention avoids the necessity of providing an independent hose extending between the first stage regulator 104 and the pressure gauge 122 as has been the case in the prior art.

The first chamber 102 extends through the valve housing 100 and includes a shoulder 124. An O-ring 126 is seated against the shoulder 124 and cooperates with a frusto-conical portion 128 of a bouyancy control device inflation valve generally designated 130. The inflation valve 130 is spring biased by a compression spring 132 such that the frusto-conical portion 128 urges the O-ring 126 into sealing engagement with the shoulder 124 to prevent pressurized air from within the first chamber 102 from passing past the shoulder 124 into a second chamber 134. however, on depression of an inflation button 136 connected to the distal end 138 of the inflation valve stem 140, the frusto-conical portion 128 is lifted from the O-ring seal 126 thereby allowing pressurized air to flow from the first chamber 102 to the second chamber 134. The chamber 134 includes an extension 142 which is connected to a third hose 144 which is in turn connected to the chamber 145 of the bouyancy control device 12.

A second or exhaust valve means generally designated 146 extends through a third longitudinal chamber 148 and includes a valve stem 150 having a first and a second end 152 and 154 respectively. A tapered plug type valve head 156 is connected to the first end 152 of the exhaust valve stem 150 and an exhaust button 158 is connected to the second end 154 of the valve stem 150. A spring 160 urges the tapered valve head 156 into sealing engagement with a correspondingly shaped conical opening 162 in the valve housing 100. When the exhaust button 158 is urged against the biasing force of the spring 160, air contained within the chamber 145 of bouyancy control device 12 is able to be exhausted from the chamber 145 through the third hose 144, through the second chamber 134 and through the opening 162 into the third chamber 148 and outwardly through a mouthpiece 164. Alternatively, by depression of the exhaust button 158, a diver may blow air through the mouthpiece 164 and through the chambers 148 and 134 respectively in order to manually inflate the chamber 145 of the bouyancy control device 12.

The great advantage of the improved inflation and exhaust valve assembly of the present invention is that the pressure gauge is rigidly connected to the valve housing thereby avoiding the need for the provision of an independent fourth hose connecting the pressure gauge to the first stage regulator.

In operation of the inflation and exhaust valve assembly, according to the present invention, the second hose 114 is coupled to the spigot 116 of the valve housing 100 thereby permitting the reading of the air pressure within the tank 30 by means of the gauge 122.

When the bouyancy chamber 145 of the bouyancy control device 12 is to be inflated, the inflation button 136 is depressed thereby permitting air from the first stage regulator 104 to flow through the first chamber 102 past the shoulder 124 and through the third hose 144 to the bouyancy chamber 145.

Alternatively, with the inflation valve 130 in the closed position as shown in FIG. 11, the exhaust valve 146 is opened to permit air to be blown manually through the mouthpiece 164 and through chambers 148 and 134 directly into the bouyancy chamber 145.

In order to deflate the bouyancy chamber 145, the exhaust button 158 is pushed in order to open the exhaust valve 146 thereby permitting pressurized air from the bouyancy 145 to flow through the third hose 144 and through chamber 134 and 148 and outwardly through the mouthpiece 166.

In emergencies, if no air is left within the tank 30, a limited amount of air may be drawn by a diver through the mouthpiece 164 in order to use the air contained within the bouyancy chamber 145.

The present invention provides a unique remote control device for remotely and simultaneously controlling the release of weights from a plurality of pockets defined by the diving bouyancy control device and overcomes the aforementioned problems associated with the previously proposed individually releasable flaps associated with the weight retaining pockets in the prior art.

The remote control device of the present invention provides an improved safety factor to the diving art by permitting the easy ejection from the diving bouyancy control device of the weights thereby permitting the diver to quickly gain positive bouyancy.

The valve for permitting inflation and exhausting of the bouyancy chamber of a bouyancy control device provides a significant improvement over the prior art devices because it avoids the necessity of providing an independent hose for connecting the pressure gauge to the first stage regulator.

The present disclosure includes that contained in the appended claims as well as that of the foregoing description. Although, the invention has been described in its preferred form with a certain degree of particularity, it is understood that the present invention of the preferred form has been made only by way of example, that numerous changes in the details of construction and the combination and arrangement of parts may be resorted to without departing from the spirit and the scope of the invention.

What is claimed is:

1. A remote control weight release device for diving buoyancy control device, said remote control device comprising in combination:

a sheet of flexible material secured to the buoyancy control device, said material and the buoyancy control device defining therebetween a pocket for the releasable reception therein of the weight, said pocket having a first open end such that the weight may freely exit from said pocket through said first open end of said pocket;

said sheet of flexible material further includes a seam for securing said sheet of flexible material adjacent to the buoyancy control device, such that said sheet of flexible material, said seam and the buoyancy control device define a second closable end which is disposed opposite to said first open end, said second open end permitting the loading of the weight therethrough;

fastening means disposed adjacent to said first open end of said pocket for fastening said first open end of said pocket for controlling the passage of the weight through said first open end of said pocket; and remote control means connected to said fastening means for remotely controlling said fastening means such that in a first position of said control means said fastening means closes the first open end of said pocket to inhibit the passage of the weight therethrough, and such that in a second position of said control means said fastening means releases the first open end of the pocket to permit the weight to pass through said first open end of the pocket to increase the buoyancy of the diving buoyancy control device.

2. A remote control weight release device as set forth in claim 1 wherein said second closeable end of said pocket further includes:

a zip means for closing said second end of said pocket.

3. A remote control weight release device as set forth in claim 1 wherein said fastening means further includes:

a plurality of first eyelets extending through said sheet of flexible material adjacent to said first open end of said pocket;

a second eyelet extending through the bouyancy control device and aligned with said first plurality of eyelets;

a flexible loop secured to the inner surface of said sheet of flexible material such that when said pocket is folded concertinawise, said flexible loop extends from said inner surface of said sheet of flexible material through aligned eyelets of said first plurality of eyelets and threaded through said second eyelets;

removable means extending through said flexible loop to lock said flexible loop in said first position of said control means in which said flexible loop extends through said first plurality of eyelets and said second eyelet to maintain said first open end of said pocket in a closed disposition thereof to inhibit the passage of the weight therethrough.

4. A remote control weight release device for a diving buoyancy control device, said remote control device comprising in combination:

a sheet of flexible material secured to the buoyancy control device, said material and the buoyancy control device defining therebetween a pocket for the releasable reception therein of the weight, said pocket having a first open end such that the weight may freely exit from said pocket through said first open end of said pocket;

fastening means disposed adjacent to said first open end of said pocket for fastening said first open end of said pocket for controlling the passage of the weight through said first open end of said pocket;

remote control means connected to said fastening means for remotely controlling said fastening means such that in a first position of said control means said fastening means closes the first open end of said pocket to inhibit the passage of weight therethrough, and such that in a second position of said control means said fastening means releases the first open end of the pocket to permit the weight to pass through said first open end of the pocket to increase the buoyancy of the diving control device;

a handle disposed adjacent to the buoyancy control device and remote from said first open end of said pocket;

a guide channel defined by the buoyancy control device extending between said handle and said first open end of said pocket; and a flexible cord means extending from and connected to said handle, said flexible cord means extending through said guide channel such that the distal end of said flexible cord passes through said fastening means to maintain said first open end of said pocket in a closed disposition thereof when said flexible cord is in said first position of said control means, said distal end of said flexible cord being disengaged from said fastening means on movement of said handle away from said guide channel to thereby release said fastening means for permitting said first open end of said pocket to open, thereby permitting the passage of the weight therethrough.

5. A remote control weight release device as set forth in claim 4 wherein said fastening means further includes:

a flexible loop secured to and extending from the inner surface of said sheet of flexible material adjacent to said first open end of said pocket;

a plurality of first eyelets extending through said sheet of flexible material and disposed adjacent said first open end of said pocket such that when said sheet of flexible material is folded into a z-shaped transverse configuration said flexible loop and said first plurality of eyelets are aligned relative to each other thereby permitting said flexible loop to be threaded through said plurality of aligned eyelets;

a second eyelet extending through the bouyancy control device and aligned with said first plurality of eyelets such that the flexible loop extends through said second eyelet and is prevented from retracting through said first plurality of eyelets and said second eyelet by the interengagement with said distal end of said flexible cord such that said distal end of said flexible cord extends through said flexible loop to maintain said first open end of said pocket in a closed position thereof to retain therein the weight and enabling the distal end of the cord to be pulled by said handle out of engagement with said flexible loop to retract said flexible loop through said first plurality of eyelets and said second eyelet to open the first open end of said pocket to permit the passage of the weight therethrough to increase the buoyancy of the diving bouyancy control device.

6. A remote control weight release device as set forth in claim 5 wherein said second eyelet extends through a lining material secured to the bouyancy control device, such that said guide channel guides said distal end of said flexible cord between said lining and the bouyancy control device for interengagement with the said flexible loop.

7. A remote control weight release device as set forth in claim 6 wherein the bouyancy control device defines a plurality of slots for the reception of loop-shaped straps therethrough; and a buckle secured to the distal end of each of said loop-shaped straps for securing a tank against the bouyancy control device by the clamping operation of said buckles.

8. A remote control weight release device as set forth in claim 2 wherein the bouyancy control device further includes:

a first portion which defines said plurality of slots;

an inverted T-shaped portion permanently secured to said first portion, said T-shaped portion further including a plurality of body engaging straps for securing the bouyancy control device around the torso of a diver.

9. A remote control weight release device as set forth in claim 8 wherein said sheet of flexible material is secured to said inverted T portion of the bouyancy control device.

10. A remote control weight release device for a diving bouyancy control device, said remote control device comprising in combination:

a sheet of flexible material secured to the bouyancy control device, said material and the bouyancy control device defining therebetween a pocket for the releasable reception therein of the weight, said pocket having a first open end such that the weight may freely exit from said pocket through said first open end of said pocket;

fastening means disposed adjacent to said first open end of said pocket for fastening said first open end of said pocket for controlling the passage of the weight through said first open end of said pocket;

remote control means connected to said fastening means for remotely controlling said fastening means such that in a first position of said control means said fastening means closes the first open end of said pocket to inhibit the passage of the weight therethrough, and such that in a second position of said control means said fastening means releases the first open end of the pocket to permit the weight to pass through said first open end of the pocket to increase the buoyancy of the diving bouyancy control device, said remote control means further including:

a handle disposed adjacent to the bouyancy control device and remote from said first open end of said pocket, said handle being disposed in an easily located position;

a guide channel defined by the bouyancy control device extending between said handle and said first open end of said pocket; and a flexible cord means extending from and connected to said handle, said flexible cord means extending through said guide channel such that the distal end of said flexible cord passes through said fastening means to maintain said first open end of said pocket in a closed disposition thereof when said flexible cord is in said first position of said control means, said distal end of said flexible cord being disengaged from said fastening means on movement of said handle away from said guide channel to thereby release said fastening means for permitting said first open end of said pocket to open, thereby permitting the passage of the weight therethrough.

11. A remote control weight release device for a diving bouyancy control device, said remote control device comprising in combination:

a sheet of flexible material secured to the bouyancy control device, said material and the bouyancy control device defining therebetween a pocket for the releasable reception therein of the weight, said pocket having a first open end such that the weight may freely exit from said pocket through said first open end of said pocket;

fastening means disposed adjacent to said first open end of said pocket for fastening said first open end of said pocket for controlling the passage of the weight through said first open end of said pocket;

remote control means connected to said fastening means for remotely controlling said fastening means such that in a first position of said control means said fastening means closes the first open end of said pocket to inhibit the passage of the weight therethrough, and such that in a second position of said control means said fastening means releases the first open end of the pocket to permit the weight to pass through said first open end of the pocket to increase the buoyancy of the diving bouyancy control device, said remote control means for further including:

a handle disposed adjacent to the bouyancy control device and remote from said first open end of said pocket;

a guide channel defined by the bouyancy control device extending between said handle and said first open end of said pocket; and a flexible cord means extending from and connected to said handle, said flexible cord means extending through said guide channel such that the distal end of said flexible cord passes through said fastening means to maintain said first open end of said pocket in a closed disposition thereof when said flexible cord is in said first position of said control means, said distal end of said flexible cord being disengaged from said fastening means on movement of said handle away from said guide channel to thereby release said fastening means for permitting said first open end of said pocket to open, thereby permitting the passage of the weight through said first open end of said pocket, said fastening means further including:

a flexible loop secured to and extending from the inner surface of said sheet of flexible material adjacent to said first open end of said pocket;

a plurality of first eyelets extending through said sheet of flexible material and disposed adjacent said first open end of said pocket such that when said sheet of flexible material is folded into a z-shaped transverse configuration said flexible loop and said first plurality of eyelets are aligned relative to each other thereby permitting said flexible loop to be threaded through said plurality of aligned eyelets;

a second eyelet extending through the bouyancy control device and aligned with said first plurality of eyelets such that the flexible loop extends through said second eyelet and is prevented from retracting through said first plurality of eyelets and said second eyelet by the interengagement with said distal end of said flexible cord such that said distal end of said flexible cord extends through said flexible loop to maintain said first open end of said pocket in a closed position thereof to retain therein the weight and enabling the distal end of the cord to be pulled by said handle out of engagement with said flexible loop to retract said flexible loop through said first plurality of eyelets and said second eyelet to open the first open end of said pocket to permit the passage of the weight therethrough to increase the buoyancy of the diving bouyancy control device.

12. A remote control weight release device as set forth in claim 11 wherein said second eyelet extends through a lining material secured to the buoyancy device, such that said guide channel guides said distal end of said flexible cord between said lining and the buoyancy control device for interengagement with said flexible loop.

* * * * *

UNITED STATES PATENT AND TRADEMARK OFFICE

CERTIFICATE OF CORRECTION

PATENT NO. : 4,608,940

DATED : Sep. 2, 1986

INVENTOR(S) : Dennis G. Bulin

It is certified that error appears in the above-identified patent and that said Letters Patent are hereby corrected as shown below:

Column 10, Claim 1, line 67, "a second closable end" should be --a closable second open end--.

Signed and Sealed this

Fourth Day of November, 1997

*Attest:*

Bruce Lehman

BRUCE LEHMAN

*Attesting Officer*

*Commissioner of Patents and Trademarks*